United States Patent [19]

Knauf

[11] Patent Number: 4,941,071

[45] Date of Patent: Jul. 10, 1990

[54] QUICK MOUNTING ARRANGEMENT FOR LIGHT FIXTURES IN OVERHEAD CABINETS AND THE LIKE

[75] Inventor: Marvin C. Knauf, Conklin, Mich.

[73] Assignee: Steelcase, Inc., Grand Rapids, Mich.

[21] Appl. No.: 307,683

[22] Filed: Feb. 7, 1989

[51] Int. Cl.[5] ..... A47B 23/06

[52] U.S. Cl. ..... 362/133; 362/374; 362/368; 362/365; 362/220

[58] Field of Search ..... 362/133, 127, 37, 217, 362/220, 285, 147, 148, 427, 368, 372, 364, 365; 248/222.1, 222.2, 222.3; 312/223, 270, 293, 350; 52/28

[56] References Cited

U.S. PATENT DOCUMENTS

| | | | |
|---|---|---|---|
| 3,154,001 | 10/1964 | Zurawski | 98/40 |
| 3,555,267 | 1/1971 | Sutter | 362/374 |
| 3,697,743 | 10/1972 | Eagle | 362/374 |
| 3,831,019 | 8/1974 | Halfaker et al. | 240/9 R |
| 3,860,829 | 1/1975 | Fabbri | 362/148 |
| 4,155,111 | 5/1979 | Kelly et al. | 362/374 |
| 4,164,009 | 8/1979 | Maguire, Jr. et al. | 362/127 |
| 4,203,639 | 5/1980 | VandenHoek et al. | 339/22 R |
| 4,222,093 | 9/1980 | Garcia et al. | 362/147 |
| 4,279,397 | 7/1981 | Larsson | 248/221.3 |
| 4,300,185 | 11/1981 | Wakematsu | 362/147 |
| 4,365,449 | 12/1982 | Liautaud | 52/28 |
| 4,419,717 | 12/1983 | Price et al. | 362/148 |
| 4,424,554 | 1/1984 | Woloski et al. | 362/365 |
| 4,432,044 | 2/1984 | Lautzenheiser | 362/223 |
| 4,454,569 | 6/1984 | Maguire | 362/127 |
| 4,497,014 | 1/1985 | Woloski et al. | 362/150 |
| 4,739,460 | 4/1988 | Kelsall | 362/365 |

FOREIGN PATENT DOCUMENTS

| | | | |
|---|---|---|---|
| 2462653 | 3/1981 | France | 52/28 |

OTHER PUBLICATIONS

"Movable Walls/Mobiles", by Steelcase Inc., 1982, Form No. S-150-82-R1082.

*Primary Examiner*—Charles J. Myhre
*Assistant Examiner*—D. M. Cox
*Attorney, Agent, or Firm*—Price, Heneveld, Cooper, DeWitt & Litton

[57] ABSTRACT

A quick mounting arrangement detachably mounts a light fixture or the like in an overhead cabinet of a furniture article. Front and rear mounting ledges are located in the lower portion of the cabinet and are oriented to generally face one another. Two mounting pins protrude from the rear side of the light fixture, and at least one latch protrudes from the front side of the light fixture. Each latch includes a spring loaded slide pin, with a thumb tab to manually shift the slide pin from a normally extended position to a retracted position. During installation of the light fixture, the mounting pins are positioned on the rear ledge, each slide pin is retracted, and the front side of the light fixture is pivoted upwardly into the bottom of the cabinet. Each slide pin is then released to engage the front ledge to quickly and securely mount the light fixture in the cabinet without requiring any tools.

18 Claims, 3 Drawing Sheets

QUICK MOUNTING ARRANGEMENT FOR LIGHT FIXTURES IN OVERHEAD CABINETS AND THE LIKE

CROSS REFERENCE TO RELATED APPLICATIONS

The present application is related to co-pending U.S. patent application Ser. No. 307,775 pending, filed Feb. 7, 1989, entitled MODULAR FURNITURE, which is hereby incorporated by reference.

BACKGROUND OF THE INVENTION

The present invention relates to furnishings for offices and other similar settings, and in particular, to a mounting arrangement for light fixtures in overhead cabinets, cases, or the like.

Open office plans are well known in the art, and generally comprise large, open floor spaces that are partitioned off into individual workstations. One arrangement for partitioning off the open floor space is to provide movable partition panels that are configured to receive hang-on furniture units, such as worksurfaces, overhead cabinets, shelves, etc. Such partitioning arrangements are usually known in the office furniture industry as "systems furniture".

A unique alternative arrangement for dividing and partitioning open office plans is disclosed in related co-pending application Ser. No. 307,775 pending, filed Feb. 7, 1989, entitled MODULAR FURNITURE, which has been incorporated by reference into the present application. This new arrangement provides a plurality of individual furniture units, each of which is independently supported on the floor of the open office. The freestanding furniture units have a novel modular construction which permits them to be individually arranged and combined in predetermined configurations to create distinct workstations.

In both systems furniture and modular furniture arrangements, light fixtures may be mounted underneath overhead cabinets, upper cases, or similar storage units to provide task lighting for the worksurface disposed therebelow. Heretofore, such light fixtures were attached directly to the bottom of the overhead cabinet by conventional fasteners, such as threaded screws or the like. Exemplary task lighting arrangements are disclosed in U.S. Pat. Nos. 4,203,639 and 4,432,044. In such mounting arrangements, the position of the light fixture in the cabinet is fixed, and cannot be readily adjusted once it is fastened in place. Furthermore, the relative size and weight of the light fixture, as well as the rather difficult location and orientation of attachment, renders installation of the light fixture both awkward and time consuming, and often requires more than one skilled installer.

SUMMARY OF THE INVENTION

One aspect of the present invention is a detachable mounting arrangement to quickly and securely mount light fixtures and the like in overhead cabinets, without requiring any tools. Front and rear mounting ledges are located in the lower portion of the cabinet, and are oriented to face one another. Mounting pins protrude from one side of the light fixture, and at least one latch protrudes from an opposite side of the light fixture. Each latch includes a spring loaded slide pin, with a thumb tab to manually shift the slide pin from a normally extended position to a retracted position. During installation of the light fixture, the mounting pin is positioned on one of the ledges, the slide pins are retracted, and the free side of the light fixture is pivoted upwardly into the bottom of the cabinet. The slide pins are then released to engage the opposite mounting ledge, thereby enabling a single installer to easily and securely mount the light fixture without requiring any tools whatsoever.

The principal objects of the present invention are to provide a mounting arrangement which is capable of quickly and securely mounting light fixtures, and the like in overhead cabinets, without requiring any tools. Spring loaded latches enable a single installer to easily mount and remove the light fixture in a convenient and strain free manner. Thumb tabs are provided on the latches to facilitate manually reciprocating the same, and are preferably rotatable, so that they can be shifted into a fully retracted position out of sight to prevent inadvertent release of the latches. The mounting arrangement has an uncomplicated design with reduced manufacturing costs, is efficient in use, capable of a long operating life, and is particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figures 4, 4A, 5:
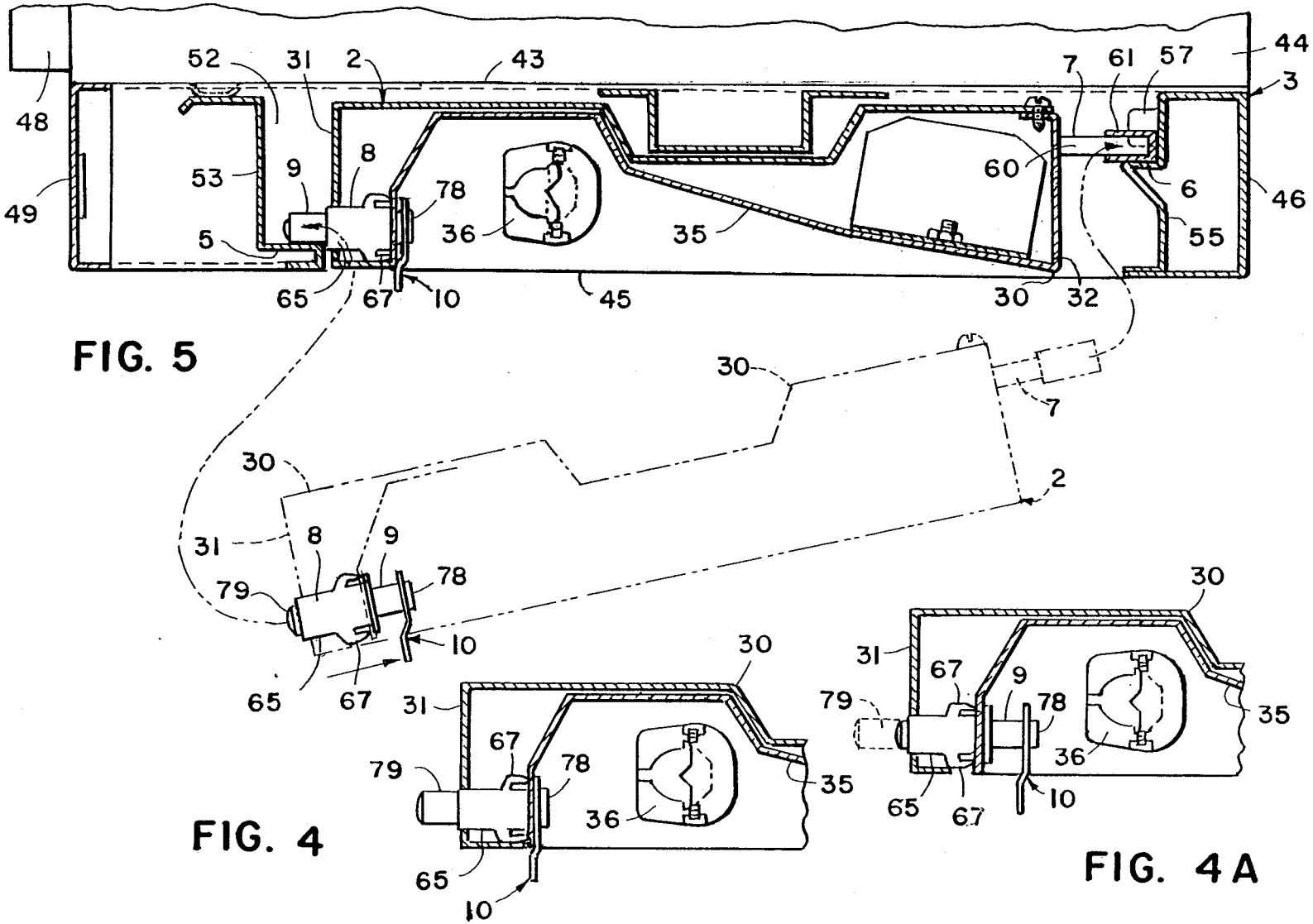
FIG. 4 is a fragmentary, vertical cross section view of the light fixture, showing a latch portion thereof in a normally, fully extended position.
FIG. 4A is a fragmentary, vertical cross-sectional view of the light fixture, showing the latch in a fully retracted position.
FIG. 5 is a fragmentary, vertical cross-sectional view of the overhead cabinet and light fixture, particularly illustrating installation of the same.

For purposes of description herein, the terms "upper," "lower," "right," "left," "rear," "front," "vertical, " "horizontal," and derivatives thereof shall relate to the invention as oriented in FIG. 5, and with respect to a seated user. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIGS. 1–4), generally designates a detachable, quick mounting arrangement embodying the present invention. Quick mounting arrangement 1 is particularly adapted to removably mount a light fixture 2 in an overhead storage unit, such as the illustrated case or cabinet 3 of modular furniture unit 4. Front and rear mounting ledges 5 and 6 (FIG. 5–8) are located in the lower portion of cabinet 3, and are oriented to face one another. Two mounting pins 7 protrude from the rear side of light fixture 2, and at least one latch 8 protrudes from the front side of light fixture 2. Each latch 8 includes a spring loaded slide pin 9, with a thumb tab 10 to manually shift slide pin 9 from a normally fully extended position (FIG. 4) to a fully retracted position (FIG. 4A). During installation of light fixture 2, mounting pins 7 are positioned on rear ledge 6, slide pins 9 are retracted, and the front side of light fixture 2 is pivoted upwardly into the bottom of cabinet 3. Slide pins 9 are then released to engage front ledge 5, so as to quickly and securely mount or support fixture 2 in cabinet 3, without requiring any tools.

Figure 3:
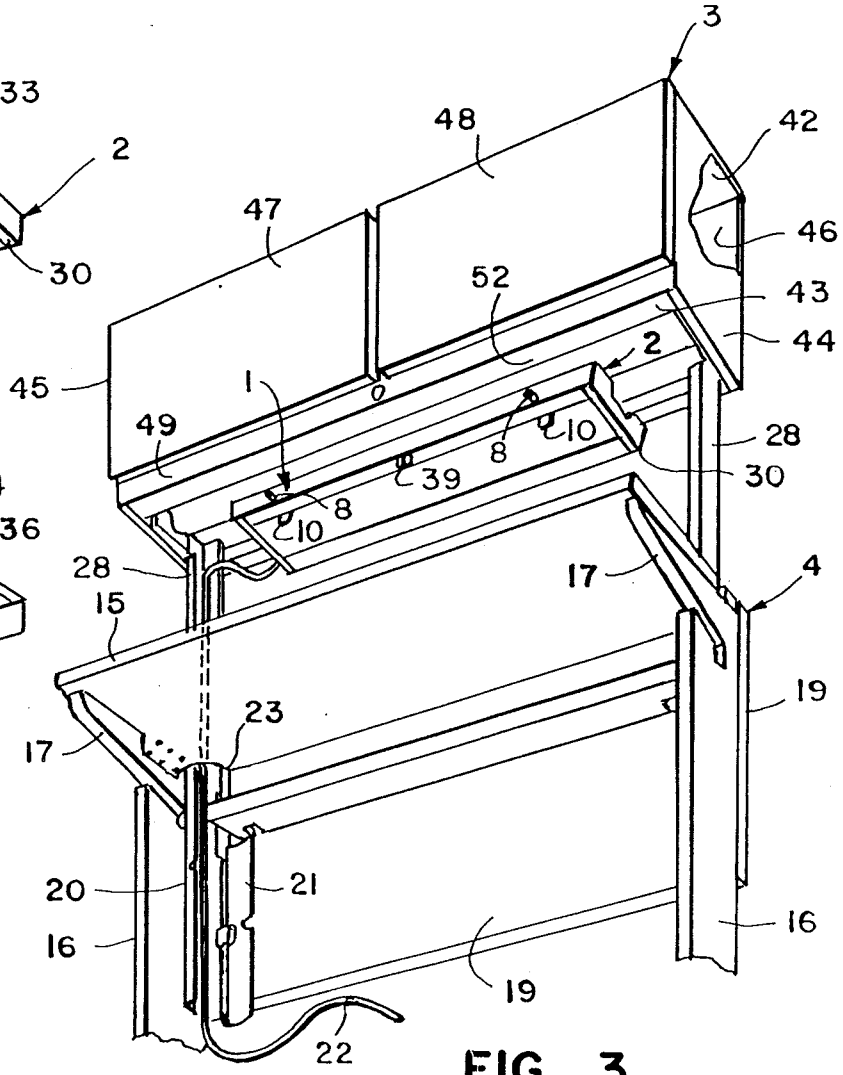
FIG. 3 is a perspective view of the light fixture, with portions thereof broken away to reveal internal construction, and shown being installed in an overhead cabinet.

With reference to FIG. 3, mounting arrangement 1 is particularly adapted for use in conjunction with a unique modular furniture arrangement, which is the subject of co-pending patent application Ser. No. 307,775 pending, filed Feb. 7, 1989, and entitled MODULAR FURNITURE, which has been incorporated by reference. The illustrated furniture arrangement comprises a plurality of individual furniture units 4, each of which is independently supported on the floor of an office space, and is shaped to cooperate with other, related furniture units 4 to form workstations. The illustrated modular furniture unit 4 is a straight worksurface unit, comprising a worksurface panel 15, which is supported at opposite ends by a pair of intermediate supports 16. Intermediate supports 16 have an inverted, generally L-shaped side elevation configuration, with an upper arm 17 thereof attached to the lower surface of worksurface panel 15, such that intermediate supports 16 support worksurface panel 15 in a cantilevered fashion. The space disposed underneath worksurface panel 15 adjacent to intermediate supports 16 is generally open and unobstructed to facilitate unfettered task chair movement along the forward edge of worksurface panel 15.

A back panel 19 (FIG. 3) is attached to the rearward edges of intermediate supports 16, extends along the rearward edge of worksurface panel 15, and generally covers the rearward face or side of modular furniture unit 4. L-shaped brackets 20 with mating removable covers 21 are attached to the interior sides of intermediate supports 16 and back panel 19, and form a covered wireway through which wiring, cabling, and the like, such as the illustrated power cord 22 may be routed. The rear corners 23 of worksurface panel 15 include arcuate cutouts which mate with the brackets 20 to route power cord 22 through worksurface panel 15, and upwardly to overhead light fixture 2.

Overhead cabinet 3 (FIG. 3) is mounted on modular furniture unit 4 above worksurface panel 15 by a pair of transaction posts 28. Transaction posts 28 have their lower ends attached to intermediate supports 16 and back panel 19, and extend vertically upwardly through the cutout rear corners 23 of worksurface panel 15 in a mutually parallel relationship. The upper ends of transaction posts 28 are attached to rearward portions of overhead cabinet 3, so as to support the cabinet in a cantilevered fashion above worksurface panel 15. The illustrated transaction posts 28 have a generally L-shaped plan configuration, and are vertically aligned with brackets 20 to form a continuous wireway through which power cord 22 may be routed from overhead cabinet 3 to the bottom of modular furniture unit 4. Removable covers (not shown) are preferably provided for transaction posts 28 to enclose the same.

The illustrated light fixture 2 (FIGS. 1 and 2) has a generally conventional construction other than mounting arrangement 1, and includes a chassis 30 with marginal edges or walls 31–34, and a formed top panel 35. In illustrated example, light fixture 2 has a formed sheet metal construction, with a recess defined in the lower portion thereof in which a pair of opposing electrical connectors or lamp holders 36 mount a fluorescent light tube 37. Light fixture 2 includes a conventional ballast (not shown), which is connected with fluorescent tube 37, and flexible power cord 22 to electrically connect light fixture 2 with a source of electrical power. A toggle switch 39 is mounted on the lower edge of front face 31, and is connected with light fixture 2 to switch fluorescent lighting tube 37 on and off.

The illustrated overhead cabinet 3 (FIG. 3) has a generally rectangular shape, and includes a top panel 42, a bottom panel 43, opposite end panels 44 and 45 and a rear panel 46, which are fixedly interconnected to form chassis 30 of cabinet 3. A channel 49 extends along the front side of overhead cabinet 3, between end panels 44 and 45, along the lower portion thereof. Front channel 49 and panels 42–45 frame an opening at the forward side of cabinet 3, which is selectively closed by a pair of pivotally mounted closures or doors 47 and 48.

With reference to FIG. 5, the bottom panel 43 of overhead cabinet 3 is positioned upwardly from the lowermost edges of front channel 49 and panels 44–46, so as to form a socket or recess 52 in the lower portion of overhead cabinet 3. A Z-shaped channel 53 is mounted adjacent front channel 49, and extends along the forward edge of overhead cabinet 3. Front channel 53 forms the generally horizontally disposed front track or ledge 5, which is in the nature of a rail, and extends generally along the length of overhead cabinet 3, and faces generally forwardly. A second channel 55 extends substantially continuously along the rearward lower portion of overhead cabinet 3, adjacent rear panel 46. Rear channel 55 includes the rear track or ledge 6, which is also in the nature of a rail, and faces generally forwardly, opposite front mounting ledge 5. In the illustrated example, front mounting ledge 5 is positioned adjacent the lowermost portion of recess 52, whereas rear mounting ledge 6 is positioned adjacent the uppermost portion of recess 52.

The length of lighting fixture 2 is preferably substantially less than the associated length of recess 52, so as to permit the longitudinal position of light fixture 2 in overhead cabinet 3 to be slidingly adjusted. The illustrated rear channel 55 includes a plurality of forwardly protruding tabs or stops 57 which are positioned to abut mounting pins 7, and thereby positively limit the longitudinal or side-to-side movement of light fixture 2 in cabinet 3. Stops 57 may be spaced apart at regular intervals adjacent the ends of rear mounting ledge 6, so as to provide a plurality of positive stop positions. When stops 57 are provided, substantial longitudinal adjustment of light fixture 2 in cabinet 3 may require removal and replacement of light fixture 2 in cabinet 3. In like manner, the width of light fixture 2 is preferably somewhat less than the width of recess 52, so as to permit fore-to-aft adjustment of the position of light fixture in overhead cabinet 3, in the manner described in greater detail hereinafter.

Figure 1:
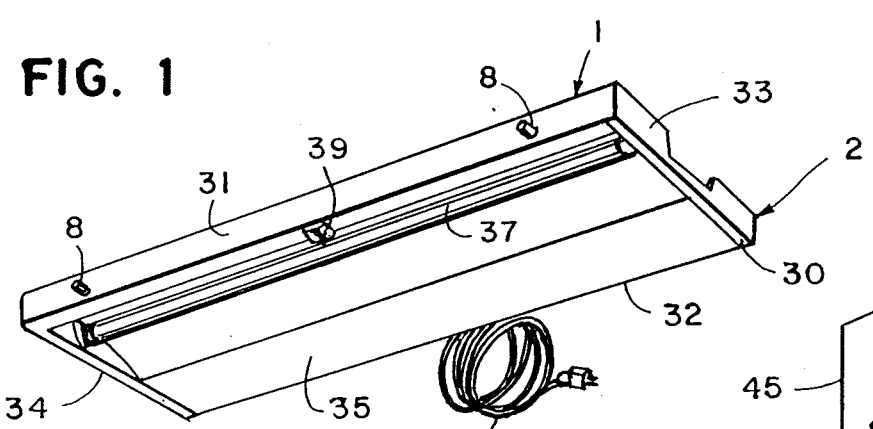
FIG. 1 is a perspective view of a light fixture incorporating a mounting arrangement embodying the present invention.
Figure 2:
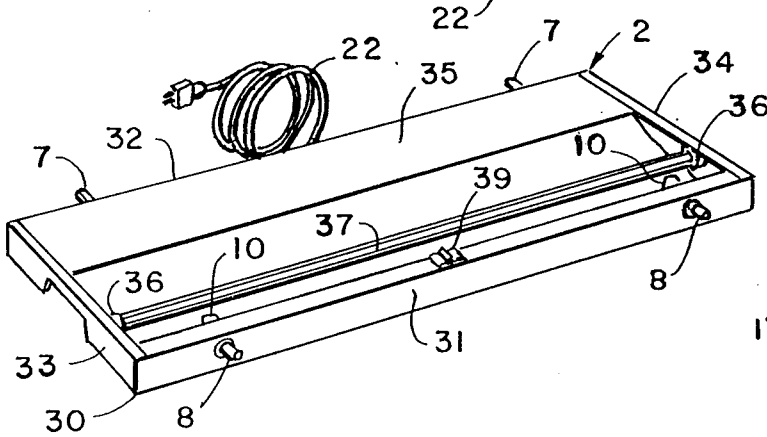
FIG. 2 is another perspective view of the light fixture.

With reference to FIGS. 1 and 2, the illustrated light fixture 2 includes two mounting pins 7 extending rearwardly from the rear wall 32 thereof adjacent opposite ends of light fixture 2. Mounting pins 7 (FIG. 5) are fixed or stationary, and have a substantially identical construction. Mounting pins 7 comprise a rigid rod or shaft 60, having a generally cylindrical shape. The interior end of each shaft 60 is rigidly attached to the rear wall 32 of light fixture 2, and is disposed in a substantially perpendicular relationship therewith. A non-slip tip or boot 61 is received over the free end of each shaft 60 and is adapted to frictionally engage rear ledge 6 to retain light fixture 2 in its set position within overhead cabinet 3.

Figure 7:
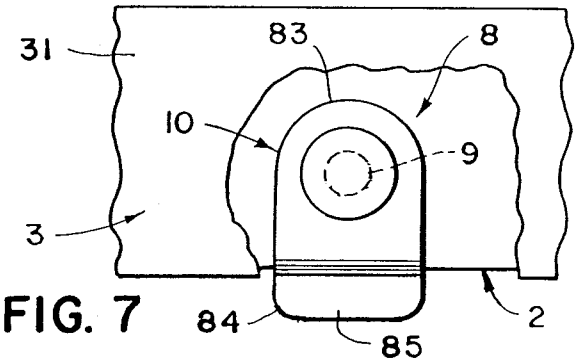
FIG. 7 is a fragmentary, front elevational view of the overhead cabinet, with a portion thereof broken away to reveal a tab portion of the latch shown in a fully extended position for installation.
Figure 7A:
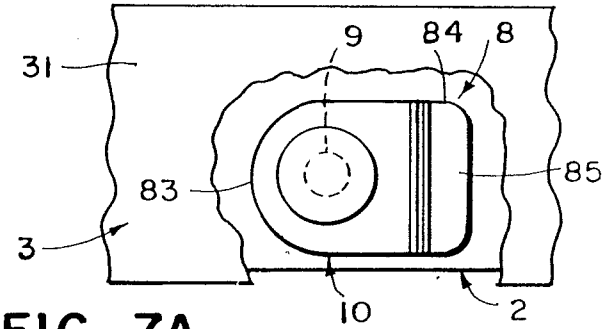
FIG. 7A is a fragmentary, front elevational view of the overhead cabinet, with a portion thereof broken away to reveal the tab portion of the latch, shown in a retracted safety position.
Figure 6A:
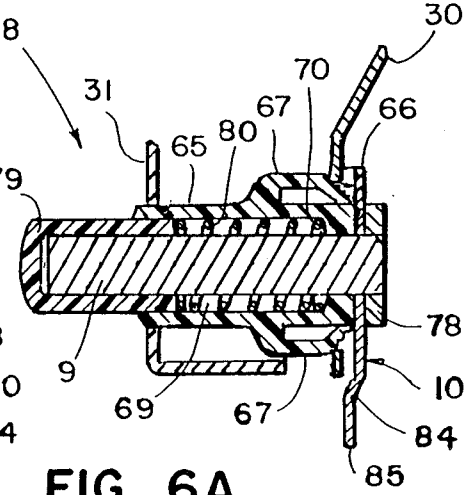
FIG. 6A is an enlarged, cross-sectional view of the latch, shown installed in the light fixture.
Figure 6:
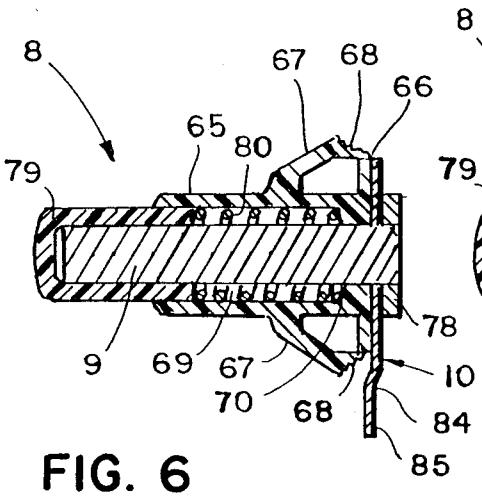
FIG. 6 is an enlarged, cross-sectional view of the latch.

In the illustrated example, light fixture 2 (FIGS. 1–3) includes two latches 8, which extend forwardly from the front wall 31 adjacent opposite ends of light fixture 2. Each latch 8 has a substantially identical construction, which as illustrated in FIG. 6–7A, includes a generally cylindrically shaped body or housing 65 in which slide pin 9 is slidingly received and retained. The front end of housing 65 includes an annularly shaped collar 66 integrally formed therewith. A pair of snap lock arms 67 are also integrally formed with housing 65, and extend forwardly toward collar 66, and include ribbed or sawtoothed free ends 68 which engage light fixture 2, and retain latch 8 therein in the fashion illustrated in FIGS. 4 and 5. The interior of latch housing 65 includes an annular recess 69 with an inner collar 70 at one end for purposes to be described in greater detail hereinafter.

In illustrated example, slide pin 9 is a rigid, cylindrically shaped rod having an enlarged forward end or head 78. A closed sleeve or cap 79 is mounted on the free end of rod 77, and preferably includes an exterior surface treatment, such as nubbing, knurling or the like for nonslide contact with front mounting ledge 5. The illustrated cap 79 has an arcuately shaped free end, which may also be knurled or otherwise surface finished for frictional abutment with the adjacent surface of front channel 53. A coil spring 80 is positioned around slide pin 9 within the interior 69 of latch housing 65, and extends between collar 70 and the interior end of cap 79 to resiliently urge slide pin 9 into a normally fully extended position. In one working embodiment of the present invention, coil spring 80 has a resilient force of approximately 8–10 pounds, to facilitate easy manual shifting of slide pin 9 between the extended and retracted positions, while assuring automatic movement to the normally extended position. Tab 10 is fixedly attached to the forward end of slide pin 9, just forward of head 78, such that both tab 10 and slide pin 9 translate and rotate together. The upper end 83 of tab 10 (as oriented in FIG. 7) is rounded in a configuration substantially identical with housing collar 66. The free end 84 of tab 10 has a substantially rectangular plan configuration with an inward inset 85. As illustrated in FIGS. 6–7A, tab 10 is rotatable for angular displacement in either a clockwise or counterclockwise direction between the exposed or extended position illustrated in FIG. 7, wherein the free end 84 of tab 10 protrudes outwardly from the bottom of cabinet 3 to access and grasp the same, and the hidden or retracted position illustrated in FIG. 7A, wherein the free end 84 of tab 10 is withdrawn out of sight or hidden within cabinet 3 and light fixture 2 to prevent inadvertently releasing latch 8. In the present example, tab 10 and slide pin 9 rotate as a unit between the extended and retracted positions.

Figure 5A:
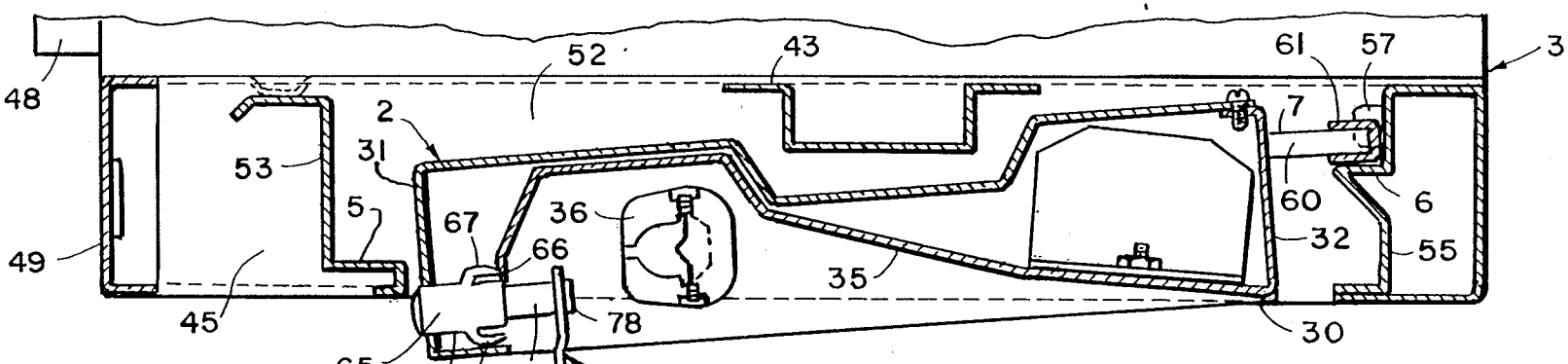
FIG. 5A is a fragmentary, vertical cross-sectional view of the overhead cabinet and light fixture, particularly illustrating an intermediate installation position.

In operation, light fixture 2 is installed in overhead cabinet 3 in the following manner. Mounting pins 7 protruding from the rear wall 32 of light fixture 2 are first positioned on rear mounting ledge 6. The installer then grasps or engages the tabs 10 of each latch 8, and pushes the same rearwardly, so as to shift slide pins 9 to their fully retracted position, as shown by the broken lines in FIG. 5. With slide pins 9 fully retracted, the forward wall 31 of light fixture 2 is then rotated or pivoted upwardly into the bottom recess 52 of overhead cabinet 3. With slide pins 9 in the fully retracted position, the free ends of slide pins 9 clear the front lip of front channel 53, as shown in FIG. 5A. Once slide pins 9 are disposed above front mounting ledge 5, the installer releases tabs 10, such that coil springs 80 automatically shift slide pins 9 to their fully extended position to abuttingly engage front mounting ledge 54. Mounting pins 7 and latch pins 9 thereby quickly and securely capture light fixture 2 within overhead cabinet 3, without requiring any tools. The installer then pivots or rotates each tab 10 approximately 90 either to the right or to the left into the retracted position within light fixture 2, as shown in FIG. 7A, so as to prevent tab 10 from being inadvertently hit or otherwise engaged in a manner that might prematurely or inadvertently release latch 8. Power cord 22, which is preferably readily flexible, is routed from light fixture 2 down through the wireway formed by brackets 28 and 20, and plugged into a nearby power tap (not shown). The flexibility of power cord 22 also permits light fixture 2 to be easily pivoted up into the bottom recess 52 of overhead cabinet 3.

To remove light fixture 2 from overhead cabinet 1, the installer first rotates tabs 10 downwardly into the extended position illustrated in FIG. 7, and then repeats the above-described steps in reverse order. A tool (not shown) may be used to hook over tabs 10, and rotate the same downwardly into the extended position.

Mounting arrangement 1 is capable of quickly and securely mounting light fixture 2 in overhead cabinet 3 without any tools whatsoever. The spring loaded latches 8 permit a single installer to removably install light fixture 2 without unnecessary strain. The pivoting tabs 10 on latches 8 provide a unique safety feature which prevents inadvertently releasing latches 8.

In the foregoing description, it will be readily appreciated by those skilled in the art that modifications may be made to the invention without departing from the concepts disclosed herein. Such modifications are to be considered as included in the following claims, unless these claims, by their language expressly state otherwise.

The embodiments of the invention in which an exclusive property or privilege is claimed are defined as follows.

1. In combination, a furniture article of the type having an overhead storage unit, a light fixture, and a mounting arrangement detachably mounting said light fixture in said furniture unit under said overhead storage unit, said mounting arrangement comprising:

a front mounting ledge positioned in a lower portion of said overhead storage unit, and facing generally rearwardly;

a rear mounting ledge positioned in the lower portion of said overhead storage unit, and facing generally forwardly;

at least two mounting pins fastened to said light fixture, and protruding generally outward from a first side thereof; said mounting pins being shaped for abutting support on one of said front and rear mounting ledges;

at least one spring loaded latch mounted in said light fixture, and including a longitudinally shiftable slide pin selectively protruding from a second side thereof; said slide pin having a spring connected therewith to resiliently retain the same in a fully extended position for abutting support on the other of said front and rear mounting ledges, and a tab connected therewith to manually shift said slide pin from the fully extended position to a fully retracted position to clear the other of said front and rear mounting ledges, whereby said light fixture is mounted in said overhead cabinet by positioning said mounting pins on said one of said front and rear mounting ledges, grasping said tab and manually shifting said slide pin to the fully retracted position, pivoting the second side of said light fixture upwardly into the lower portion of said overhead storage unit, and releasing said slide pin, such that said spring extends said slide pin into the fully extended position to engage said other of said front and rear mounting ledges, and thereby securely mount said light fixture in said overhead storage unit without requiring any tools.

2. A furniture mounting arrangement as set forth in claim 1, wherein:

said tab is rotatably mounted for angular displacement between an extended position wherein said tab protrudes outwardly of said light fixture to access and grasp the same, and a retracted position wherein said tab is hidden within said light fixture to prevent inadvertently releasing said latch.

3. A furniture mounting arrangement as set forth in claim 2, wherein:

said mounting pins are fixed, and are mounted on a rearward side of said light fixture.

4. A furniture mounting arrangement as set forth in claim 3, wherein:

said spring loaded latch is mounted on a forward side of said light fixture.

5. A furniture mounting arrangement as set forth in claim 4, wherein:

said light fixture includes a pair of said spring loaded latches mounted adjacent opposite ends of the forward side thereof.

6. A furniture mounting arrangement as set forth in claim 5, wherein:

said front and rear mounting ledges have a length greater than the length of said light fixture, whereby said light fixture can be slid in a side-to-side direction in said overhead storage unit to adjust the position of the same.

7. A furniture mounting arrangement as set forth in claim 6, wherein:

said front and rear mounting ledges have a width greater than the width of said light fixture, whereby said light fixture can be slid in a fore-to-aft direction in said overhead storage unit to adjust the position of the same.

8. A furniture mounting arrangement as set forth in claim 7, wherein:

each slide pin includes a non-slip free end portion engaging said front mounting ledge to prevent inadvertent movement of said light fixture in said overhead cabinet 1.

9. A furniture mounting arrangement as set forth in claim 8, wherein:

each mounting pin includes a non-slip free end portion engaging said rear mounting ledge to prevent inadvertent movement of said light fixture in said overhead cabinet.

10. A furniture mounting arrangement as set forth in claim 9, wherein:

said rear mounting ledge includes a plurality of longitudinally spaced apart stops positioned to abut at least one of said mounting pins to positively limit longitudinal adjustment of said light fixture in said overhead cabinet.

11. A furniture mounting arrangement as set forth in claim 10, wherein:

said spring comprises a coil spring positioned between said slide pin and said tab.

12. A furniture mounting arrangement as set forth in claim 1, wherein:

said mounting pins are fixed, and are mounted on a rearward side of said light fixture.

13. A furniture mounting arrangement as set forth in claim 1, wherein:

said spring loaded latch is mounted on a forward side of said light fixture.

14. A furniture mounting arrangement as set forth in claim 1, wherein:

said light fixture includes a pair of said spring loaded latches mounted adjacent opposite ends of the forward side thereof.

15. A furniture mounting arrangement as set forth in claim 1, wherein:

said front and rear mounting ledges have a length greater than the length of said light fixture, whereby said light fixture can be slid in a side-to-side direction in said overhead storage unit to adjust the position of the same.

16. A furniture mounting arrangement as set forth in claim 1, wherein:

said front and rear mounting ledges have a width greater than the width of said light fixture, whereby said light fixture can be slid in a fore-to-aft direction in said overhead storage unit to adjust the position of the same.

17. In combination, a furniture article of the type having an overhead storage unit, a light fixture, and a mounting arrangement detachably mounting said light fixture in said furniture unit under said overhead storage unit, said mounting arrangement comprising:

a first mounting ledge positioned in a lower portion of said overhead storage unit, and facing generally laterally inwardly in a first direction;

a second mounting ledge positioned in the lower portion of said overhead storage unit, and facing generally laterally inwardly in a second direction;

at least two mounting means connected with said light fixture, and extending generally outward from a first side thereof; said mounting means being shaped for abutting support on one of said first and second mounting ledges;

at least one latch mounted in said light fixture, and including a longitudinally shiftable slide selectively protruding from a second side thereof; said slide having a biasing means connected therewith to resiliently retain the same in a fully extended position for abutting support on the other of said first and second mounting ledges, and a tab connected therewith to manually shift said slide from the fully extended position to a fully retracted position to clear the other of said first and second mounting ledges, whereby said light fixture is mounted in said overhead cabinet by positioning said mounting means on said one of said first and second mounting ledges, grasping said tab and manually shifting said slide to the fully retracted position, pivoting the second side of said light fixture upwardly into the lower portion of said overhead storage unit, and releasing said slide such that said biasing means extends said slide into the fully extended position to engage said other of said first and second mounting ledges, and thereby securely mount said light fixture in said overhead storage unit without requiring any tools.

18. A mounting arrangement for detachably mounting a light fixture or the like in an overhead storage unit of a furniture article, said mounting arrangement comprising:

a front mounting ledge adapted to be supported in a lower portion of the overhead storage unit, and facing generally rearwardly;

a rear mounting ledge adapted to be supported in the lower portion of the overhead storage unit, and facing generally forwardly;

at least two mounting pins adapted to be fastened to said light fixture, and protrude generally outward from a first side thereof; said mounting pins being shaped for abutting support on one of said front and rear mounting ledges;

at least one spring loaded latch adapted to be mounted in said light fixture, and including a longitudinally shiftable slide pin selectively protruding from a second side thereof; said slide pin having a spring connected therewith to resiliently retain the same in a fully extended position for abutting support on the other of said front and rear mounting ledges, and a tab connected therewith to manually shift said slide pin from the fully extended position to a fully retracted position to clear the other of said front and rear mounting ledges, whereby the light fixture is mounted in the overhead cabinet by positioning said mounting pins on said one of said front and rear mounting ledges, grasping said tab and manually shifting said slide pin to the fully retracted position, pivoting the second side of the light fixture upwardly into the lower portion of the overhead storage unit, and releasing said slide pin, such that said spring extends said slide pin into the fully extended position to engage said other of said front and rear mounting ledges, and thereby securely mount the light fixture in the overhead storage unit without requiring any tools.

* * * * *